US008002319B1

(12) United States Patent
Hahn

(10) Patent No.: US 8,002,319 B1
(45) Date of Patent: Aug. 23, 2011

(54) POOPER SCOOPER

(76) Inventor: Joseph Hahn, Cheektowaga, NY (US)

( * ) Notice: Subject to any disclaimer, the term of this patent is extended or adjusted under 35 U.S.C. 154(b) by 848 days.

(21) Appl. No.: 11/938,277

(22) Filed: Nov. 10, 2007

Related U.S. Application Data

(60) Provisional application No. 60/858,286, filed on Nov. 10, 2006.

(51) Int. Cl.
*A01K 29/00* (2006.01)

(52) U.S. Cl. ..... 294/1.4; 294/61

(58) Field of Classification Search ..... 294/1.4, 294/61; 15/104.8, 257.6
See application file for complete search history.

(56) References Cited

U.S. PATENT DOCUMENTS 1,246,487 A * 11/1917 Summers et al. ..... 294/61
1,965,177 A * 7/1934 Finkl ..... 172/21
1,993,314 A * 3/1935 Belford ..... 294/61
2,738,215 A * 3/1956 Thompson ..... 294/61
4,030,199 A * 6/1977 Russell ..... 433/147
4,617,713 A * 10/1986 Pomerenke ..... 29/426.4
4,762,133 A * 8/1988 Bayne et al. ..... 600/569
5,297,310 A * 3/1994 Cox et al. ..... 15/106
5,370,433 A * 12/1994 Yost ..... 294/50.5
5,418,999 A * 5/1995 Smith ..... 15/106
6,030,011 A * 2/2000 Layton ..... 294/1.4
6,478,351 B1 * 11/2002 Nelson ..... 294/1.4
6,554,334 B2 * 4/2003 Rincon Uribe ..... 294/1.4

* cited by examiner

*Primary Examiner* — Saul Rodriguez
*Assistant Examiner* — Stephen Vu
(74) *Attorney, Agent, or Firm* — Patricia M. Costanzo

(57) ABSTRACT

A pooper-scooper device for hands-free, no bending, scoop-up, temporary storage, release, and disposal of pet droppings having longer inner handle with attached to the ground end an ejector plate with a pattern of apertures incised throughout. Inner handle is received into shorter outer hollow handle part having a plate with skewers attached in the same pattern to its ground end. Longer inner handle extends from the ground end of the outer handle or from the top end providing for movement of its ejector plate over the length of the skewers to clean the skewers of the waste skewed. A hands-free detachable holding receptacle is an optional part and offers the use of disposable bags for collecting the waste.

18 Claims, 12 Drawing Sheets

Receptacle Variations

Enclosed Receptacle

Open Bottom Receptacle

For use with bag for collection.

POOPER SCOOPER

CROSS-REFERENCE TO RELATED APPLICATIONS

This Application claims benefit to Provisional Application No. 60/858,286 filed on Nov. 10, 2006.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to a device for picking-up litter and other waste and, more particularly, to a device that provides for sanitary, hands-free, uncomplicated, effortless skewering pick-up, and maintaining a secure hold on the waste until release and disposal of pet droppings or other types of trash or litter, a method of making the device, and a method of using the device.

The background information discussed below is presented to better illustrate the novelty and usefulness of the present invention. This background information is not admitted prior art.

Pets often kept for companionship, enjoyment, and protection often provide their owners with non-trivial health benefits, such as relieving stress. Walking a dog can provide both the owner and the dog with exercise, fresh air, and social interaction.

According to United States Pet Ownership Statistics, a study conducted by the American Pet Products Manufacturers Association (APPMA) 2003-2004 National Pet Owners Survey, there are approximately sixty-five million pet dogs in the United States with thirty-nine percent of households owning at least one dog. All dogs and dog owners benefit from walking. Walking a pet is a way to spend time with a beloved companion, in addition to providing a means of exercise that benefits both the pet walker and the pet. Moreover, many pets must be left indoors for long periods during the day, when their owner is at work, for example. For many, this also means being kept locked in a crate. Considering this, it is important to recognize that pets require exercise upon their owner's return.

Current statistics reveal that fifty-eight million Americans are classified as overweight, forty million as obese, and three million as morbidly obese. This problem extends to nearly sixteen percent of all children who are considered obese. It is increasing recognized that not only are pet owners overweight, but so are their pets. Given that obesity is an escalating problem for all, it is easy to appreciate that the exercise provided during the activity of dog-walking is as beneficial to the owner as it is to the dog.

Daily walking, for people as well as for their pets, such as dogs, reduces the risk of heart disease by enhancing blood circulation throughout the body, reduces blood cholesterol levels, prevents and manages high blood pressure, and prevents bone loss. Additionally, many people who walk their dog experience lower levels of stress and tension, as well as reduced levels of anxiety and depression. Dog walking is a relatively simple activity which should be non-taxing and should provide a pleasurable way to spend time with one's pet. Dog walking, although a pleasurable activity, brings certain obligations to dog walkers. Responsible dog walkers understand that walking one's dog in any public space means cleaning up any waste left by the dog.

Dog droppings, if left in place, can result in health risks to people, to other animals, as well as to, aquatic life. When it rains, dog waste left lying on the ground gets washed first into storm water drains and then into the nearest creek. Genetic studies of the water pollution from fecal waste in this country have found that roughly 20 percent of fecal waste form in ground water comes from dogs. This type of water pollution promotes the growth of aquatic weeds and algae, which in turn, limit light penetration and reduce oxygen levels in a water body producing environment hazards for fish and other aquatic life. Pollution from dog waste also poses a health hazard to human beings and other pets, whether it's in water or on land. Bacteria and parasites contained in the waste can infect adults and children with campylobacteriosis, salmonellosis, and toxocariasis, for example. Additionally, animal waste has exceptionally high nitrogen content, which can be harmful to native plants and grasses.

Cleaning up while walking a dog, or other animal, is simple and the courteous thing to do. Is some communities, it is illegal to not clean-up after your pet. When walking their dog, dog owners are urged to carry bags to collect their dog's waste and then to dispose of it properly. Pet walkers should take responsibility for their animals, as it is something that comes along with pet ownership.

Cleaning up after pets, is important, not only when walking the pet but in their home environment, if they are allowed to spend time in the back yard or if their pen is on unprotected soil. After all, the same ground and water contamination can occur from droppings in a back yard as from the ground in a public place.

Although being a responsible pet walker is the right thing to do, it is not always an easy thing to do. Many people have difficulty bending down to the ground to clean-up their animal's waste. People may suffer from arthritis and while finding it beneficial to their health to walk their dog also find it difficult, painful, or impossible to clean-up the dog's waste by bending down to ground level to scoop up the waste with, for instance a plastic bag. Other dog owners may be too overweight or just generally be out of shape. Moreover, others, while desiring to be responsible, find picking up animal waste, a repugnant activity, especially when their hands and noses must come too near to the waste.

Clearly, what is needed is a device that provides for hands-free cleaning-up dog waste, that allows the hands-free clean-up to be conducted in an upright position, where the device holds the waste securely until disposal is achieve, that offers environmentally-friendly use of recycled material, that can be easily and rapidly cleaned, and that is affordable.

SUMMARY

The present invention provides for a hands-free scoop-up and disposal of pet dropping waste device without requiring any bending on the part of the user. The device is specifically designed to have barbed tines to grab and hold the waste securely until disposal is achieved. The device offers environmentally-friendly use of recycled waste disposal material. The device can be easily and rapidly cleaned, and that is affordable.

The hands-free pooper-scooper, following the principles of the present invention, may be generally described as comprising a hollow outer shaft with an actuating inner rod. The end of the outer shaft that is to be near the ground is attached to a plate having densely packed tines on the surface opposite the shaft attachment. Each of the tines has a high density of barbs to achieve a good grab and hold of all but the wettest of waste, especially of pet waste. The end of the inner rod that is to be the ground end is attached to a cleaning plate having a set of holes incised throughout for acceptance of the barbed tines. The rod and shaft work together to pick up and to discard waste. At the time of manufacture the inner rod is positioned within the outer shaft. As the inner rod is longer than the outer hollow shaft, it will extend form one end or the other of the outer hollow shaft. To prevent the inner rod from falling through the outer hollow shaft in which it is contained, the top end of the inner rod is adjusted, that is shaped in a workable manner, so as to prevent the inner rod from falling back out of the outer shaft. In a resting position, the device may be described as having the cleaning plate of the rod being at the same level as the extended points of the tines. Placing the device over waste to be picked up and discarded, a gentle downward pressure on a handle of the outer hollow shaft drives the barbed-tines through the waste while simultaneously, the pushing upward action of the waste pushes the cleaning plate toward the plate from which the tines extend while the attached inner rod is pushed to extend out of the upper end of the hollow shaft. The barbed tines hold the waste securely in place until the working end of the device is places over a disposal container. To effectuate waste disposal, the raised inner handle is pushed down so that the cleaning plate can push the waste off of the tines and into a waste receptacle in a hands-free, standing up manner.

Additionally, the "pooper scooper" of the present invention offers a hinged closable waste receptacle to hold the waste until an acceptable waste container is reached for those times that a public or otherwise useable waste container is not available. The hinges, one on each end of the pooper-scooper waste receptacle, act to hold the receptacle securely on the device, and also allow for light foot pressure on one of the hinges to release the hinges grip on the device and, thus, to open the receptacle. The other hinge of the pooper-scooper waste receptacle allows the receptacle to remain attached to the pooper-scooper device. With the bottom of the receptacle on the ground, a slight downward pressure on the handle of the device will snap the open hinge back onto the device for hands-free opening and closing of the waste receptacle. The waste receptacle may be fitted with disposal bags. For environmental considerations, the disposable bags may be used grocery store plastic bags. For those walking multiple or larger dogs, the receptacle is available with an open bottom for use with larger sized refuse bags. Moreover, as described, the closed waste receptacle may easily be locked and unlock in a hands fee manner to avoid any unintended emptying of the receptacle until a waste container is identified. The pooper scooper is cost effective to manufacture, especially if made by a molding process, such as injection molding, and thus, is affordable. A short handled version is available for those who prefer the shorter handle. A shoulder strap is also available for hands free carrying of the device.

The invention with all of the above described advantages and more is made available by providing for a pooper-scooper device comprising:

a device for hands-free scooping up of moist and dry waste and for temporary holding of the waste for release and disposal, wherein the device includes, an elongated outer hollow shaft having an open first end and an open second end with a perimeter about the open second end;

a handle for holding the device attached adjacent to the open first end of the shaft;

a barbed-skewer plate sized for pick-up of animal dropping waste attached to the perimeter of the open second end of the hollow shaft, where the plate has densely spaced skewers extending from it on the opposite side of the plate from the shaft, each skewer having closely spaced barbs extending radially outward for skewing and holding the waste, an axially moveable actuating rod having a first end and a second end mounted within the hollow shaft so as to be projecting from at least one end of the shaft, an ejector plate attached to the second end of the rod, the plate having through holes arranged for receiving the skewers therethrough, the through holes providing for cleaning the skewers and ejecting the waste;

the first end of the rod providing for its movement within the shaft;

the device weighted and sized for comfortable use by children and adults, and the device requiring no springs, wires, levers, slots, or pegs.

Furthermore, the device includes a hand's free detachably attachable reusable receptacle for temporary storage of waste, where the receptacle may include a disposable liner and where the disposable liner is a recycled plastic bag.

The device also offers a wire latch for preventing the inner rod from movement within the hollow outer shaft, where the first end of the inner rod may be knob-shaped or, alternatively, where a length of the inner rod that extends from the first end of the outer shaft is bent to one side to form a handle, in order to maintain the rod in the shaft.

The extended length of the rod as compared to the shaft difference closely approximates the length of the barbed tines.

Furthermore, the shaft and the rod are of a length that provides for use of the device by an adult person standing upright, or alternatively, the shaft and the rod are of a shorter length that provides for the device to be easily stored and carried, for use by those who have no difficulty in bending down to the ground.

The receptacle of the pooper-scooper may have a closed bottom, or alternatively it may offer an open bottom from which a disposable bag may extend, when, for example, a larger-sized bag is required.

The device is made especially affordable by making the device using a molding process, and especially when the process is an injection molding process.

The device also offers an attached strap for convenient carrying of the device.

The invention further contemplates a method for making a pooper-scooper device comprising:

a method for making a device for hands-free scooping up of moist and dry waste, and temporary holding the waste for release and disposal, the method including, providing for an elongated hollow shaft having an open first end and an open second end having a perimeter about the open second end; attaching a handle for holding the device adjacent to the open first end of the shaft;

providing for a barbed-skewer plate sized for pick-up of animal droppings waste attached to the perimeter of the open second end of the shaft having densely spaced skewers extending from the plate on the opposite side from that shaft, the skewers having closely spaced barbs extending radially from each skewer for skewing and holding the waste, mounting an axially moveable actuating rod having a first end and a second end in the hollow shaft so as to be projecting from at least one end of the shaft, attaching an ejector plate to the second end of the rod, the plate having through holes arranged for receiving the skewers therethrough, the through holes arranged for receiving the skewers therethrough, the through holes providing for cleaning the skewers and ejecting the waste;

the first end of the rod providing for its movement within the shaft; the device weighted and sized for comfortable use by children and adults, and the device requiring no springs, wires, levers, slots, or pegs.

A specific pooper-scooper device may be described as comprising:

a molded pooper-scooper device for scoop-up, temporary storage, release, and disposal of pet droppings, including, a molded inner handle part having a first end and a second end, a molded ejector plate having a pattern of apertures incised throughout, the ejector plate attached to the second end of the inner handle, a molded hollow outer handle part for receiving inner handle part, the hollow outer handle part having an open first end and an open second end having a perimeter, a plate molded with a dense set of skewers extending from one side, the plate attached about the perimeter of the second end of the hollow outer handle on the side opposite the skewers part, the skewers having barbed tines densely molded on the skewers so as to extend radially from the skewers, the inner handle part received into the hollow outer handle until first end of the inner handle protrudes from the first open end of the hollow handle, the protruding part of the inner handle shaped prevent the removal of the inner handle from the outer handle, and the apertures in axial alignment with the barbed-tines providing for the movement of the barbed-tine in and out of the apertures when the inner handle is raised or lowered through the hollow handle.

BRIEF DESCRIPTION OF THE DRAWINGS

In order that these and other objects, features, and advantages of the present invention may be more fully comprehended and appreciated, the invention will now be described with reference to specific exemplar embodiments, which are illustrated in appended drawings, wherein like reference characters indicate like parts throughout the several figures. It should be understood that these drawings only depict preferred embodiments of the present invention and are therefore not to be considered limiting in scope. The invention will now be described and explained with additional specificity and detail through the use of the accompanying drawings, in which.

A LIST OF REFERENCE NUMERALS AND THE PARTS TO WHICH THEY REFER

Figures 1A, 1B:
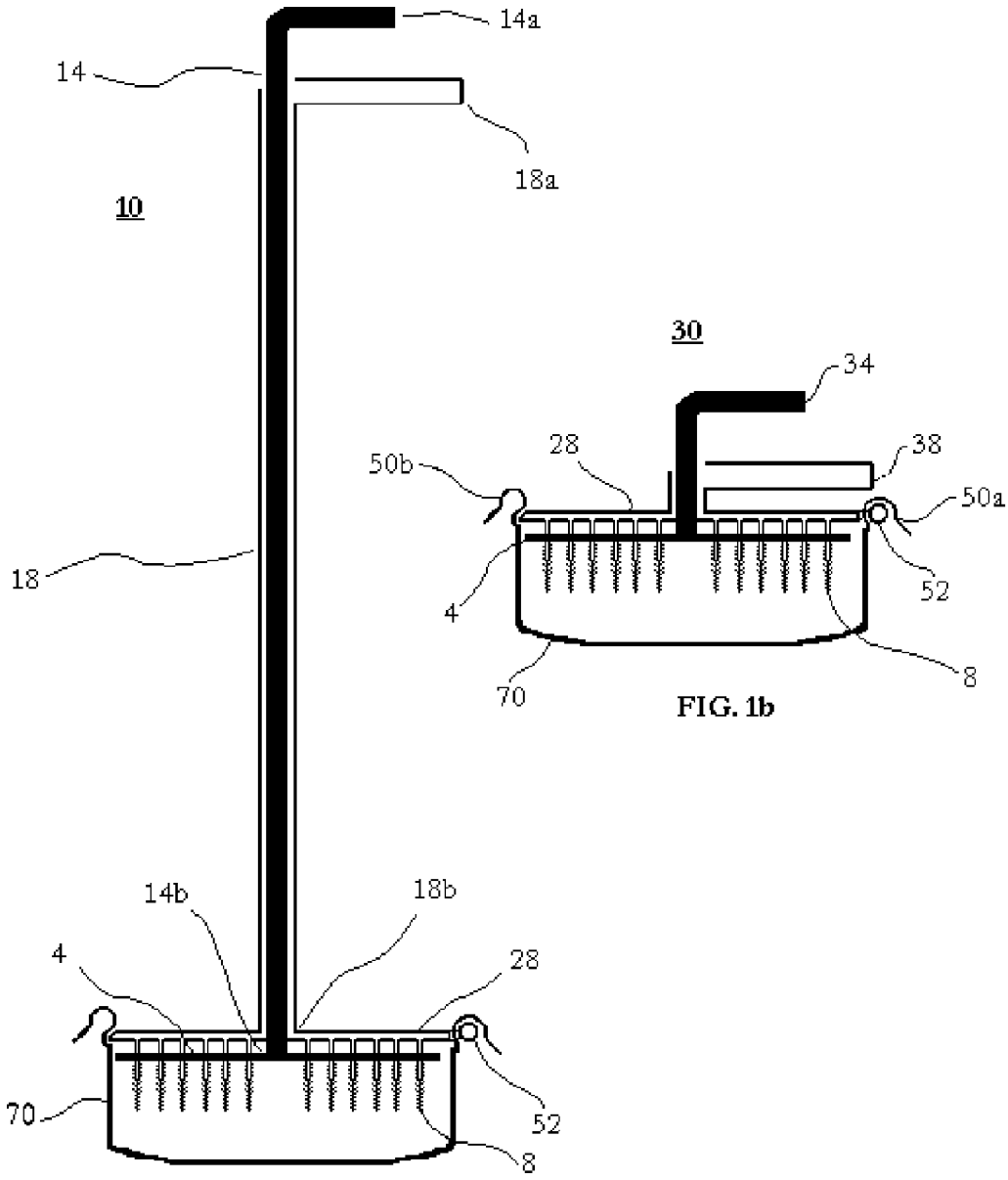
FIG. 1*a* is a transparent side elevation view of a long handle pooper scooper device.
FIG. 1*b* is a transparent side elevation view of a short handle pooper scooper device.

4 A cleaner or ejection plate.
8 Barbed-tines extending from barbed-tine plate 28.
8*a* Barbed-tined receiving apertures incised into ejector plate 4.
10 Full-size pooper scooper.
10 Inner handle part of pooper scooper 10.
14*a* First end of inner handle part 14.
14*b* Second end of inner handle part 14.
14*c* Knob design for first end of inner handle part 14.
18 Hollow outer handle part of pooper scooper 10.
18*a* First end of hollow handle part 18; also refers to the handle part that is part of first end of hollow handle part.
18*b* Second open end of hollow handle part 18.
28 Barbed-tine plate.
30 Carry along short-sized pooper scooper.
34 Handle part of short-sized carry-along pooper scooper 38.
38 Carry along short-sized pooper scooper.
38 Aperture for insertion of gudgeon 50*a*.
50*a* Gudgeon.
50*b* Receptacle snap lock hinge or spring hinge.
52 A pintle.
52*a* Lip of gudgeon 50*a* for fitting into aperture 40 adjacent pintle 52.
60 Excrement receiving bag.
65 Excrement.
70 Receptacle (temporary storage container).
72*a* Closed Bottom Receptacle (temporary storage container).
72*b* Open Bottom Receptacle (temporary storage container).
73 Ledge-like lip molded as part of the receptacle on its inside side upper edge.
75 Closed surface of receptacle 70.
78 Bag holding slot.
80 Lock mechanism for locking handle knob 14*c* in a closed position.

DEFINITIONS

Cleaner plate, as used herein, refers to the plate that ejects the waste picked up by the barded tine plate, and hence it may also be referred to as an ejector plate.

Container, as used herein, refers to any object that can be used to hold things, especially a boxlike object of desired dimensions and shape that can be loaded for transport of the load, and/or that can be fitted with a disposable or non-disposable protective removable insert.

Excrement, as used herein, refers to any animal droppings.

Gudgeon, as used herein, refers to a circular fitting, often made of metal, which is fixed onto some surface. It allows for the pivoting of another fixture, such as a pintle, which is a male type of hinge pin which pivots in the hole in the gudgeon. As such, a gudgeon is a simple bearing or hinge.

Handle, is used herein with reference to the elongated hollow outer shaft, the elongated inner rod, or the end part of the inner rod that is used as a handle.

Pintle, as used herein, refers to a pin or bolt, usually inserted into a gudgeon, which is used as part of a pivot or hinge.

Receptacle or container, as used herein, typically refers to an item in which things are stored, a container that holds items or matter, a container that holds, contains, receives a liquid or solid, which includes waste and excrement Tines, as used herein, also refers to skewers, such as the tines or skewers that are used for skewering pet waste, as described herein.

Waste, as used herein, refers to any solid or semi-solid waste that is to be picked up and discarded, including animal droppings or other waste, such as paper or leaves on a ground surface.

It should be understood that the drawings are not necessarily to scale. In certain instances, details which are not necessary for an understanding of the present invention or which render other details difficult to perceive may have been omitted.

DETAILED DESCRIPTION

Referring now, with more particularity, to the drawings, it should be noted that the disclosed pooper-scooper invention is disposed to embodiments in various sizes, shapes, and forms, such as long handled versions for adults and shorter handle versions for young children or those who are able to bend down to the ground without difficulty. Depending on the size animal that is being walked, the size of the "poop" container can vary. The shape of the "poop" container and the barbed-tined plate may also vary as desired. The material used to manufacture the device can vary, for example one may choose a light weight plastic, a heavier but more stylish wood, or a sturdy stainless steel. Therefore, the embodiments described herein are provided with the understanding that the present disclosure is intended as illustrative and is not intended to limit the invention to the embodiments described herein.

The present disclosure teaches a "pooper scooper" device invention providing for sanitary hands-free poop scoop-up, temporary storage if required or desired, and ultimate ejection and disposal of the scooped-up pet droppings; a method of making and a method of using the device.

Figure 3:
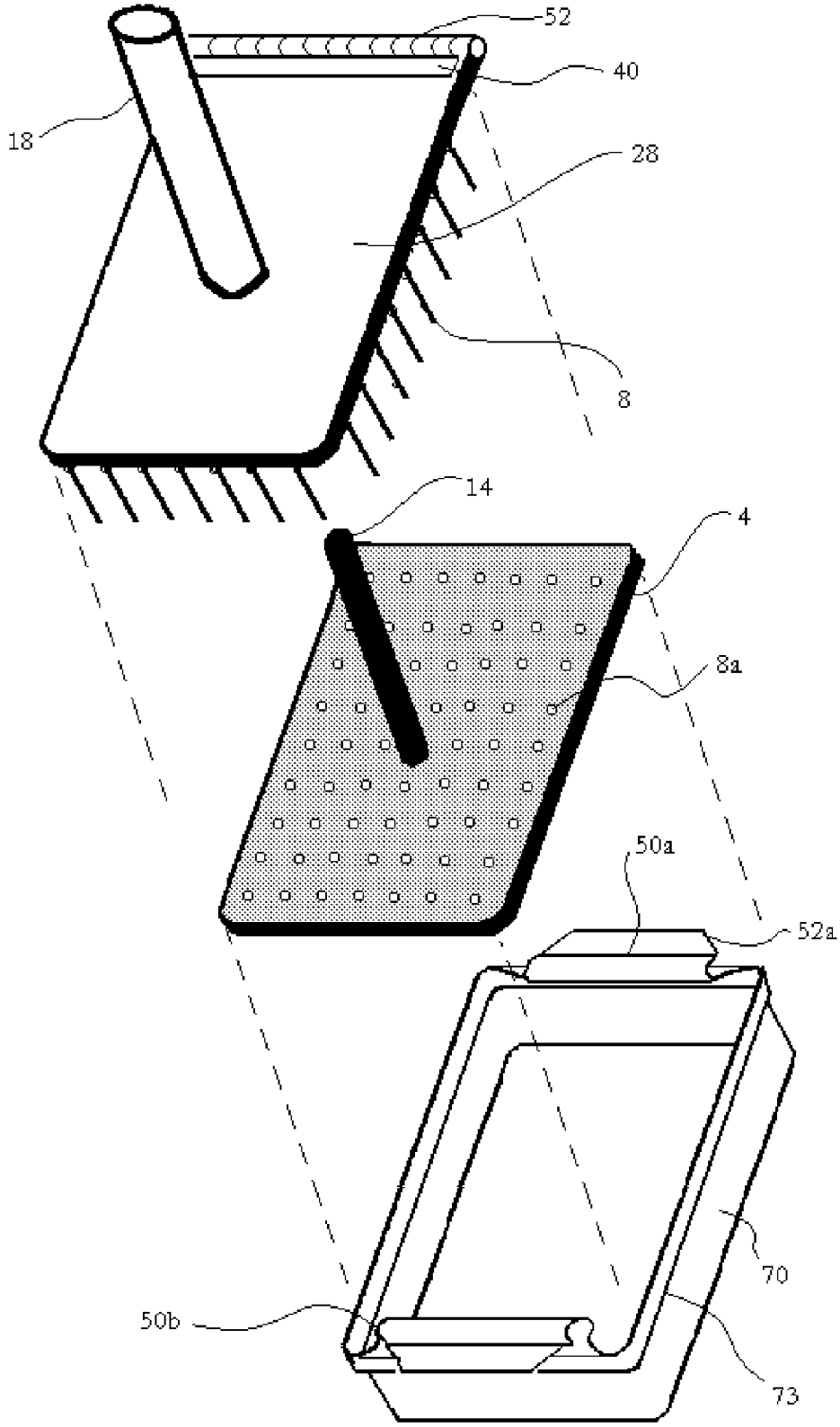
FIG. 3 is a perspective view of a barbed-tine plate with partial handle, ejection plate with partial handle, and a receptacle of the pooper scooper device, as illustrated in FIG. 1.

FIG. 1*a*, a side transparent plan view, illustrates one favored embodiment of pooper scooper device 10 featuring a full-length two-part handle comprising outer hollow handle part 18 having first end 18*a* and second end 18*b*, and inner-handle part 14 having first end 14*a* and second end 14*b*. Note that outer-handle and inner-handle are terms that may be used interchangeably with hollow outer shaft and inner rod, respectively. Outer-handle 18 is designed to incorporate within its hollow length space inner-handle 14, which may be hollow or solid, as desired, as long as the inner-handle is structured to fit inside the hollow space of the handle part 18 and is slightly longer than the outer handle. Plate 28 is also formed by molding. Once formed, plate 28 is welded, or otherwise attached to handle part 18 so that the plate extends about the perimeter of the handle's second end 18*b* so as not to cover open end 18*b* of handle 18. It is understood that the plate, if desired may also be molded at the same time and in the same mold as the outer handle. These various types of manufacture are chosen according to cost or availability of the needed mold. The various means plates and handles manufacture are within the scope of the present invention. The attachment of the plate to the handle results in the configuration as illustrated with handle 18 extending away from the side of plate 28 to which it is welded part, so that the largest area dimension sides of the plate are approximately perpendicular to the long axis of handle 18. Also during the molding process, barbed tines 8 are molded onto the side of surface plate 28 that is opposite to the side from which handle 18 extends. The tines may be of any desired, workable material, such as metal or plastic. Barbed tines 8 are arranged to extend straight out from plate 28 in a predetermined pattern. The barbs are an especially important aspect of the invention as making the tines without the barbs produces a workable leaf or paper litter picker upper, but does not produce a workable pooper-scooper because without the presence of the barbs on the tines moist waste simply slides off of the tines. Thus, the straight nails that were contemplated by earlier art will not work to pick-up animal waste. The barbs must be flexible enough and shaped to slide through the apertures of the cleaning plate as discussed following. Inner-handle part 14 is molded to have "cleaning" plate 4 formed as a seamless extension of the handle's second end 14*b* which is positionally analogous to the second end of the outer handle, so that plate 4 is also disposed to have its largest surface area sides roughly perpendicular to the long axis of handle 14. Plate 4 is formed having a predetermined pattern of apertures or through holes, as illustrated in FIG. 3. The predetermined pattern of the tines is complementary to the predetermined pattern of the through holes so that through holes 8*a* of inner-handle's working plate 4 can accept tines 8 of barbed-tined plate 28 of outer-handle 18. The two-part handle, as illustrated in FIG. 1*a*, is of a length that provides for its use, while maintaining a standing upright position, to scoop-up, release, and dispose of pet droppings, thus eliminating need for bending or stooping. The two part handle is designed to provide for easy movement of the cleaning plate over the tines without having to resort to the use of springs, wires, levers, tension, pegs, or slots, as must be relied on in earlier art. These parts are most often made with metal that rusts, bends, and breaks. The parts then require replacement. Even if the parts are not made of metal they are parts that require movement, usually in conjunction with another part. These specialized mechanisms add to the cost of manufacture and thus to the consumer cost while severely limiting the lifetime and usability of the device. Moreover, these devices are susceptible to the effects of weather and of cleaning. The preferred embodiment, as described herein, is extremely cost effective, because it can be molded at low cost and requires few parts. Moreover, this device is made of material that is relatively impervious to weather and is easy to keep clean and sanitary. It is also within the scope of the invention to include other means providing for movement of the cleaning plate over the tines. Such other means are known in the art and need not be discussed here. Receptacle 70 provides for temporary enclosed storage of the contents until they may be discarded, is an optional part of the device. Disposal insert containers, such as new or used plastic bags, may be conveniently used with the receptacle to keep the receptacle clean, sanitary, and free of malodorous odors (See FIG. 6*b*).

FIG. 1*b*, another transparent side plan view, illustrates a short-handled version pooper scooper device 30, wherein inner handle 34 and hollow outer handle 38 are of a shorter length to provide for the device to be easily stored, transported, and hand carried. As explained for the long-handled version, attached to and extending from the perimeter of a second open end of hollow handle 38 is barbed-tine plate 28. On the surface of the plate that faces away from handle 38 is a set of barbed-tines 8 extending from the plate. The barbed-tines are positioned on plate 28 in any desired pattern. Note the grasping barbs extending out along the length of tines 8 in both the long handled and short handled version of the device ensure that skewered pet droppings are held securely on the tines until a refuse receptacle is at hand, whether that receptacle is receptacle 70 that may be supplied as part of the device or a standard refuse container, such as ones that are often found along public walk-ways.

Figure 2A:
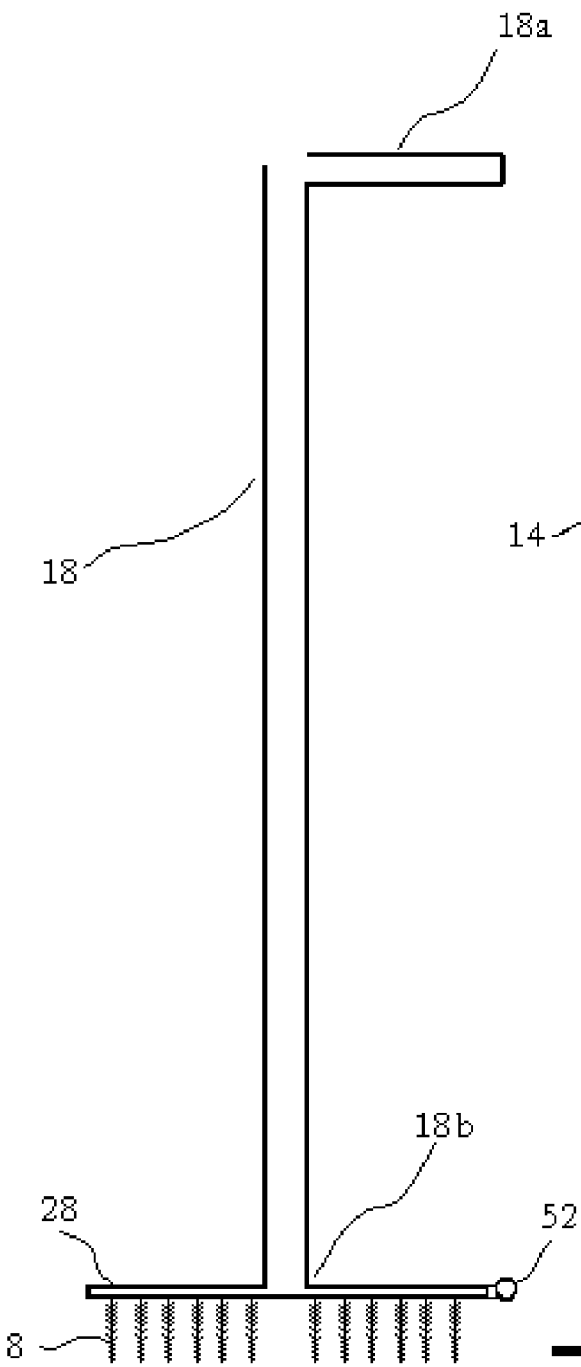
FIG. 2*a* is a side elevation view of the hollow shorter handle with barbed-tines part of the two-part handle of the long handle pooper scooper device as illustrated in FIG. 1*a*.
Figure 2B:
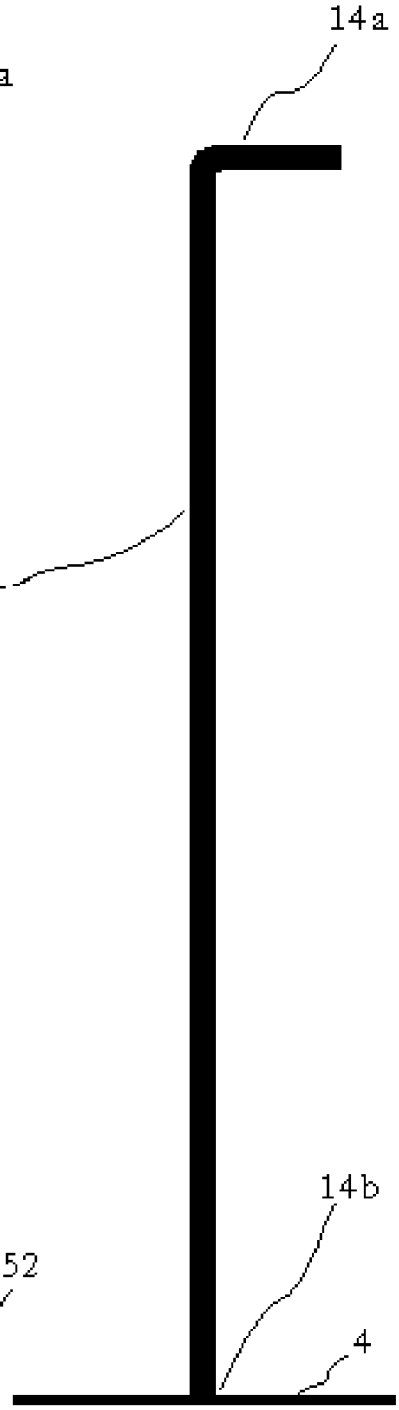
FIG. 2*b* is a side elevation view of the inner longer handle with ejector plate part of the two-part handle of the long handle pooper scooper device as illustrated in FIG. 1*a*.

FIGS. 2*a* and 2*b*, both side plan views, illustrate outer hollow handle part 18 and inner handle part 14 apart from each other. Hollow outer handle part 18 and inner handle part 14 are both molded. In the embodiment illustrated, during the final stages of manufacture, handle 14 is introduced into hollow handle part 18 at open end 18*b* until first end 14*a* of longer inner handle 14 protrudes from first open end 18*a* of hollow handle part 18 at which time, first end 14*a* of inner handle 14 is bent to an angle (see FIG. 1*a*), wherein such angled handle acts, in part, to maintain inner handle 14 securely within the outer handle, so that the inner handle can not fall out of hollow handle part 18. See FIG. 7, for an illustration of a knob-stop configuration, which is another way to keep the inner handle secure within the outer handle.

Figure 2C:
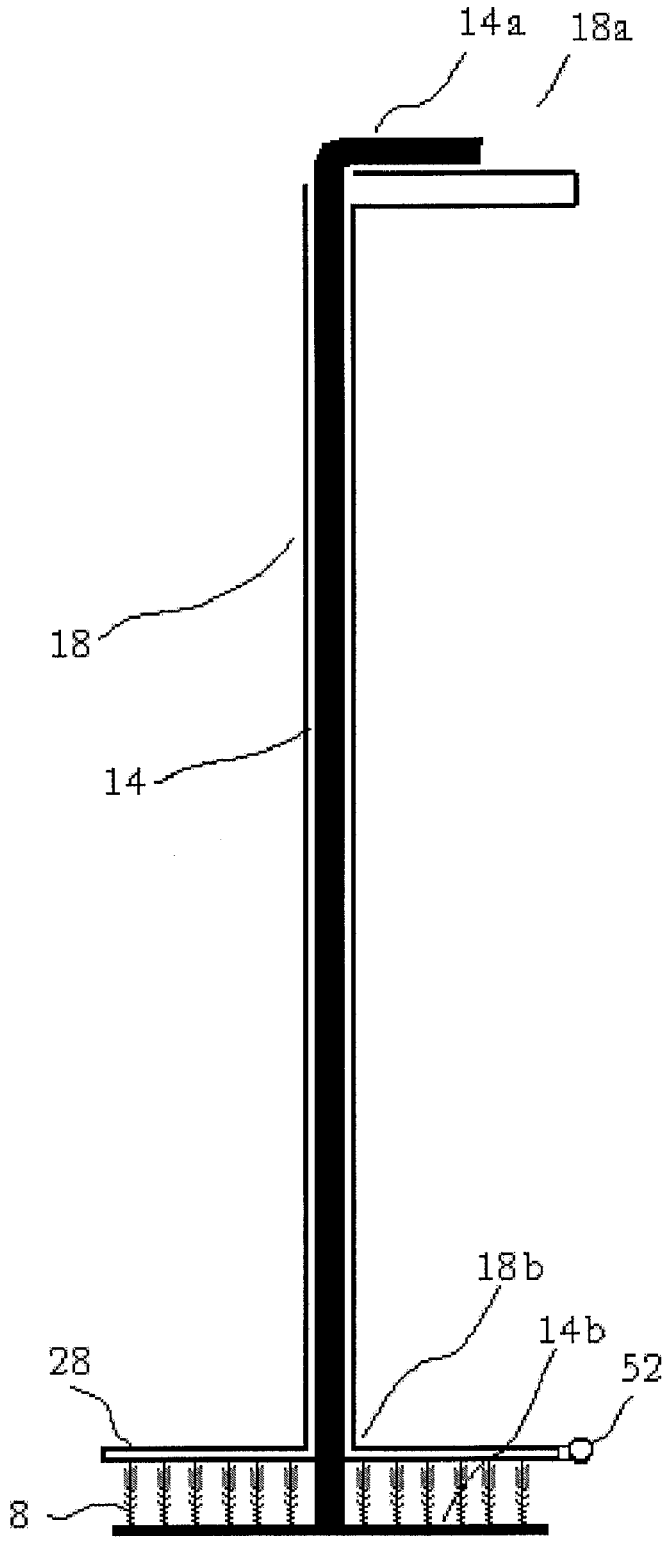
FIG. 2*c* is a transparent side elevation view of the inner longer handle of the two-part handle within the long handle of the pooper scooper device as illustrated in FIG. 1*a*.

FIG. 2*b* describes one way to structure inner handle part 14. As explained above, extending from the perimeter of second end 14*b* of inner handle part 14 is planar ejector cleaner plate part 4 whose perimeter shape conforms to the shape of the barbed-tine plate. Incised through the surface of ejector plate 4 is a set of apertures or through holes where each of these openings is positioned, shaped, and sized to accept a barbed-tine there through when inner handle part 14, positioned within hollow handle 18, may be drawn up (as illustrated in FIG. 1*a*) to have ejector cleaner plate 4 adjacent barbed-tine plate 28. The action of gravity on inner-handle 14 means that in its stand-up resting position ejector cleaner plate 4 is aligned with the skewering tips of tines 8 FIG. 2*c*. It is in this configuration that the pooper-scooper is placed over a waste mass to be picked-up and discarded. As the outer handle is descended with only a mild pressure required to push the barbed tines through the waste mass, the bulk of the waste mass pushes back against ejector cleaner plate 4 so that it is raised to be closer to plate 28. As cleaner plate 4 is raised, it follows that inner handle 14 is also raised relative to end 18*a* of the outer handle. In this position, the waste is securely held by the barbed tines and the cleaner ejector plate is positioned for use. When a waste container is located, another slight pressure down-wards on inner handle 14 will cause handle 14 to be moved down into hollow handle 18 and ejector plate 4 to be pushed away from plate 28 so that the perimeter edge of each aperture of the plate, is caused to slides about its related tine, to push skewered pet droppings off of each barbed-tine either into the receptacle box for temporary storage, into a temporarily attached disposable bag, or into a pet waste container. The tines and barbs have the degree of flexible stiffness that is required for them to skewer and support pet waste until it is discarded. Moreover, although the device, even the long handled embodiment, when manufactured from a strong yet light material, is lightweight in use, it is also sturdy.

FIG. 3 is a partially enlarged perspective view of: (1) barbed-tine plate 28 with a cut-off hollow outer handle 18 extending from plate 28 in one direction and tines 8 extending from plate 28 in the opposite direction (note that for clarity, the barbs of the otherwise barbed-tines are not illustrated), pintle 52, and aperture 40 adjacent pintle 52; (2) a cut-off hollow handle part 18 extending from ejection plate 4 toward the tined side of plate 28 and having an arrangement of barbed-tine receiving apertures 8*a* incised throughout the entire thickness of ejector plate 4, and (3) optional receptacle 70 of the pooper scooper device, as illustrated in FIG. 1. Each end of two opposing ends of receptacle 70 has snap lock hinges 50*a* and 50*b* providing for secure attachment of receptacle 70 to and ease of release from plate 28. To provide for ease of attachment of receptacle 70 to plate 28 and release of receptacle 70 from plate 28, each of the snap lock hinges 50*a* and 50*b* provides for a different attachment mechanism. To firmly, but reversibly, secure the receptacle to the pooper-scooper, the outer and inner handles are positioned relative to each other so that the tines of plate 28 extend through the apertures of plate 4 so the plates are approximately in contact with each other. At this time, lip 52*a* of hinges 50*a* of receptacle 70 is fitted into aperture 40 adjacent pintle 52. To attach the receptacle to the device in a closed position, this action is followed by snapping hinges 50*b* over plate 28. It should be appreciated that once lip 52*a* of gudgeon 50*a* is fitted into aperture 40 the receptacle may be opened and closed as illustrated in the series of FIG. 5 without requiring any hand action.

Figures 4, 4A, 4B:
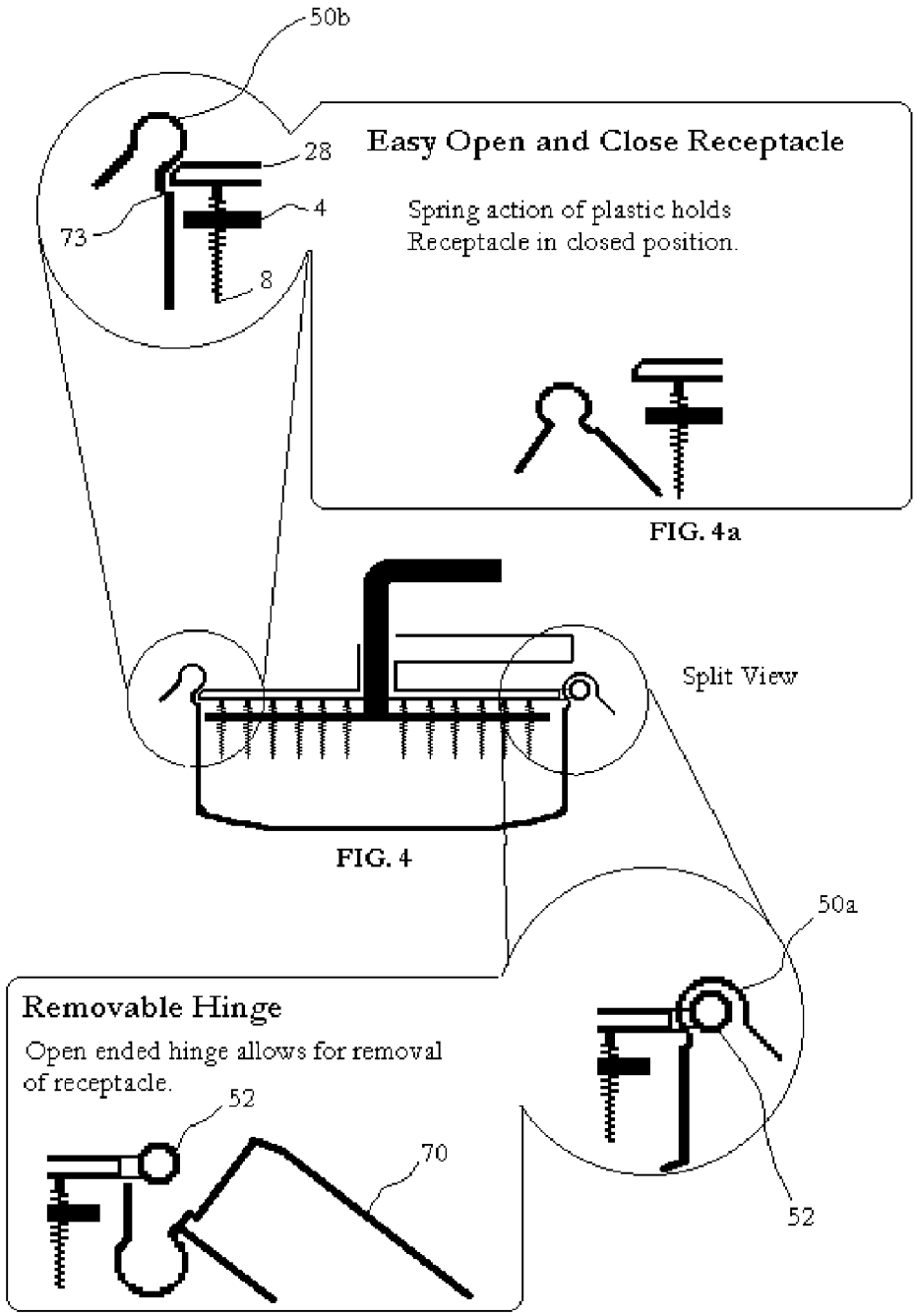
FIG. 4 is a side plan view of a short handled version of the pooper scooper to better illustrate how the hinges function to provide hands-free release of the receptacle part of the pooper scooper from the handle part of the pooper scooper.
FIG. 4*a* is an exploded side plan view of the snap close hinge of the receptacle part of the pooper scooper.
FIG. 4*b* is an exploded side plan view of the pintle/gudgeon hinge of the receptacle part of the pooper scooper.

FIG. 4, FIG. 4*a*, and FIG. 4*b* provide detailed, enlarged views of the hinging gudgeon mechanisms described in the paragraph just above. FIG. 4, a side plan view, illustrates how hinges function together to provide for a sturdy attachment of the receptacle to the device and for hands-free release of the receptacle part of the pooper scooper from the handle part of the pooper scooper. FIG. 4*a*, an exploded side plan view, illustrates the spring-like action of the snap close hinge 50*b* of the receptacle part of the pooper scooper. FIG. 4*b*, an exploded side plan view, illustrates pintle/gudgeon hinge 50*a* of the receptacle part of the pooper scooper.

Figure 5A:
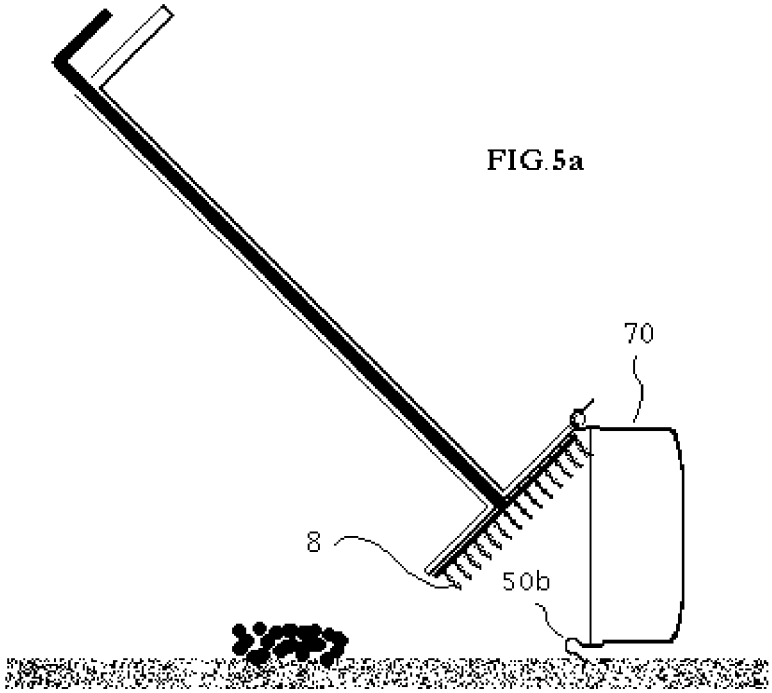
FIGS. 5*a*-5*i* are a series of drawings illustrating how the present invention is used for hands-free pick up and containment of animal droppings.
Figure 5B:
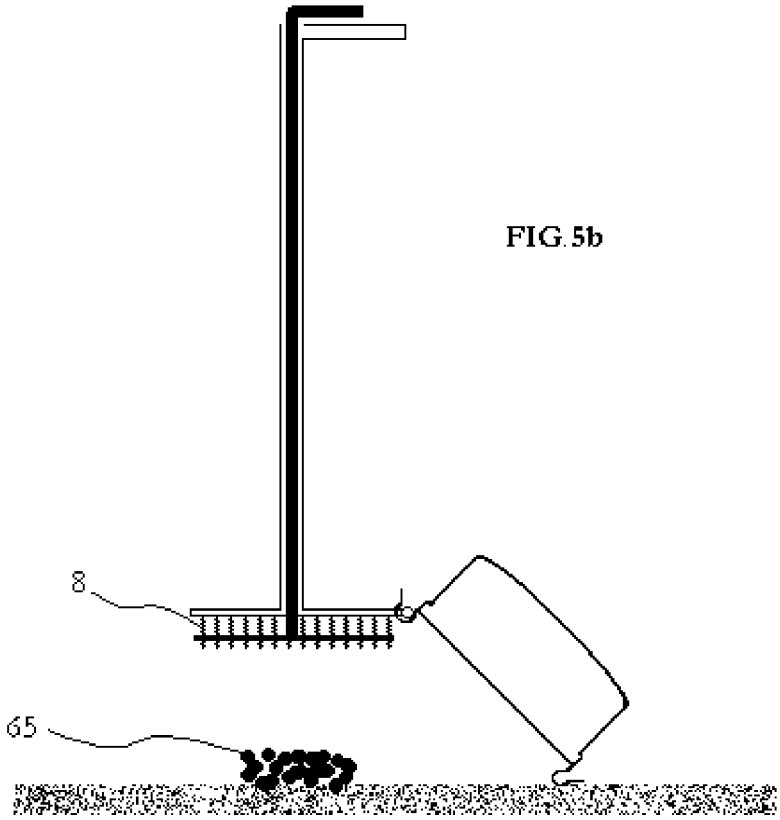
Figure 5C:
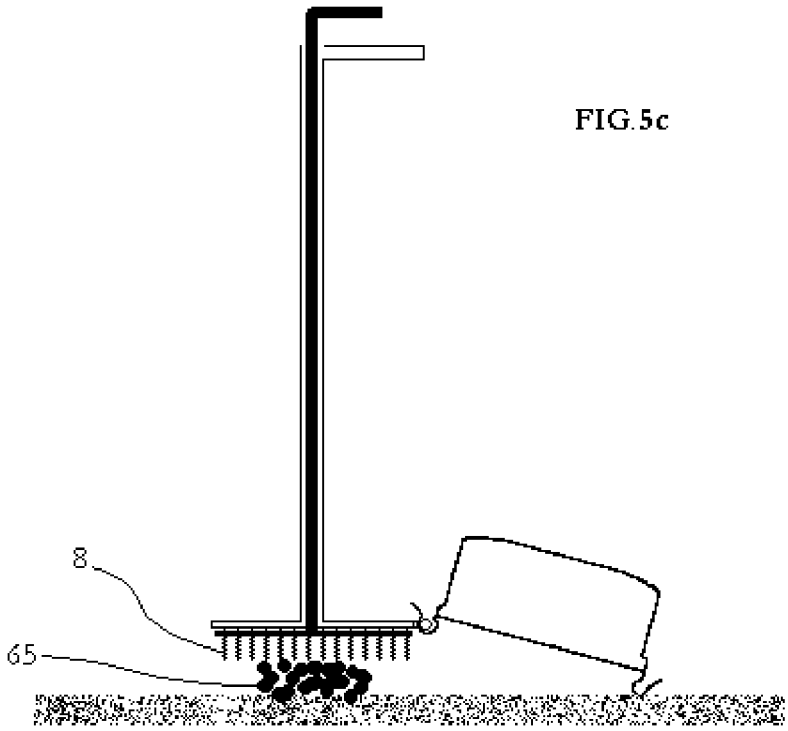
Figure 5D:
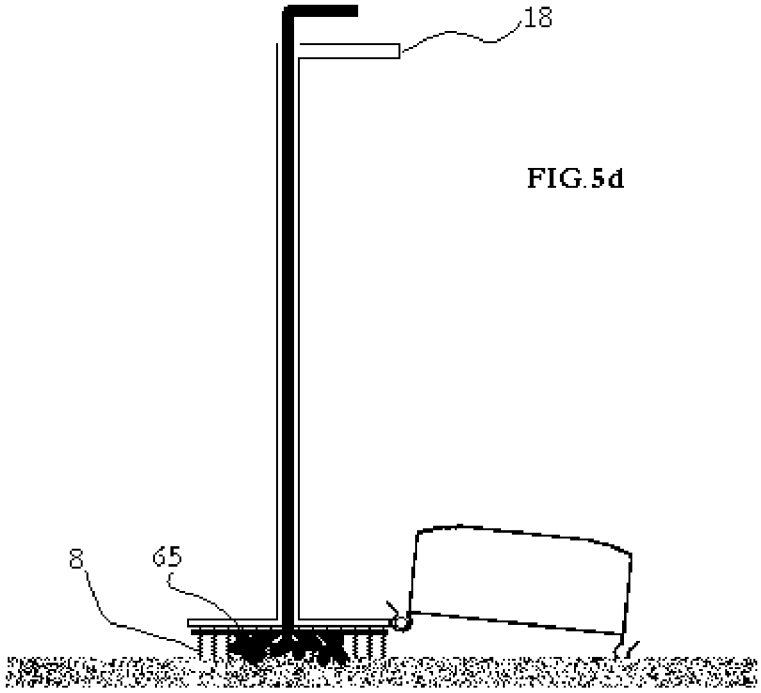
Figure 5E:
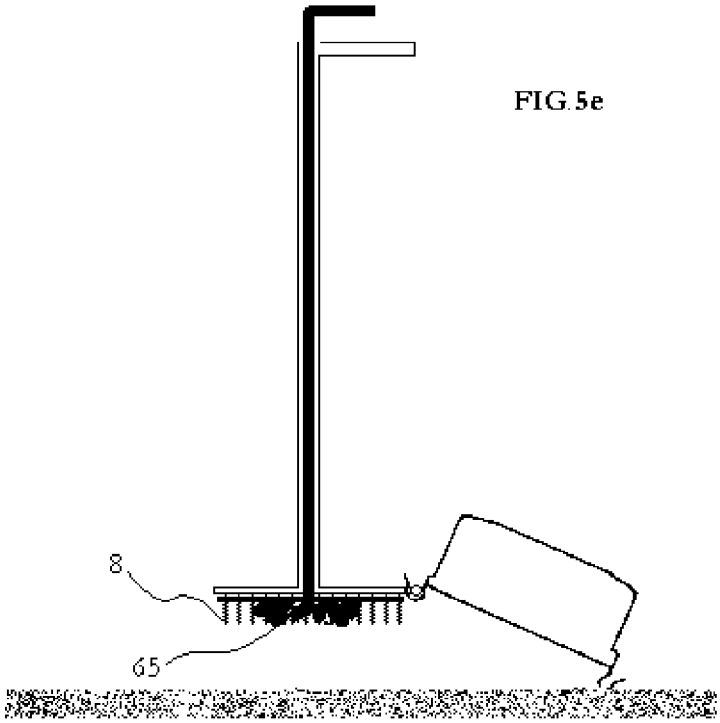
Figure 5F:
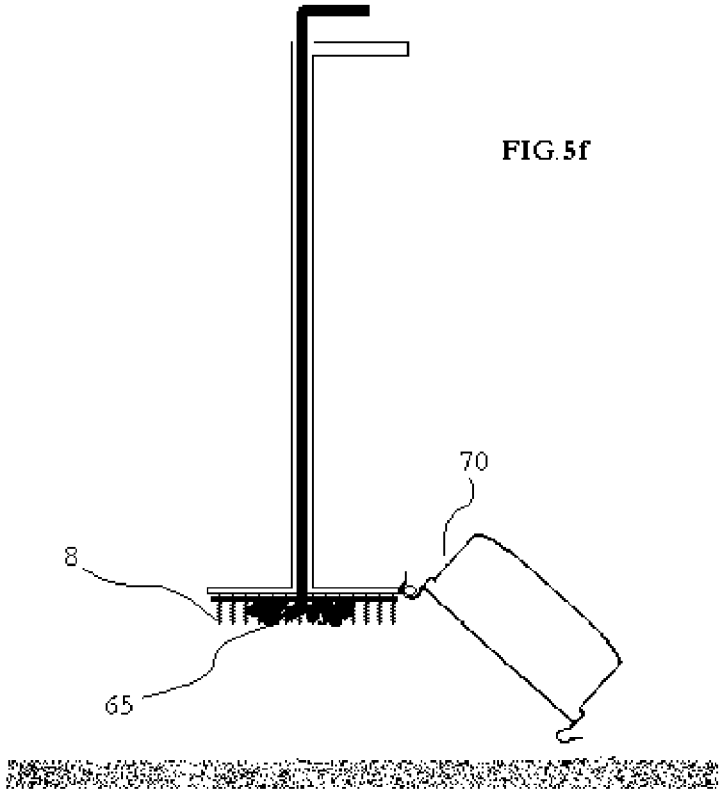
Figure 5G:
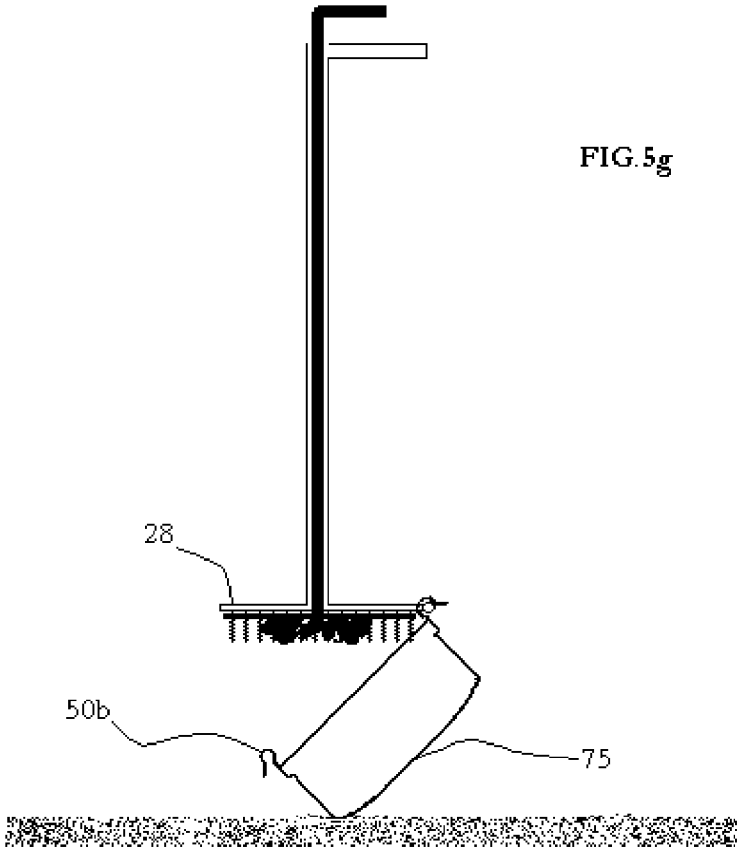
Figure 5H:
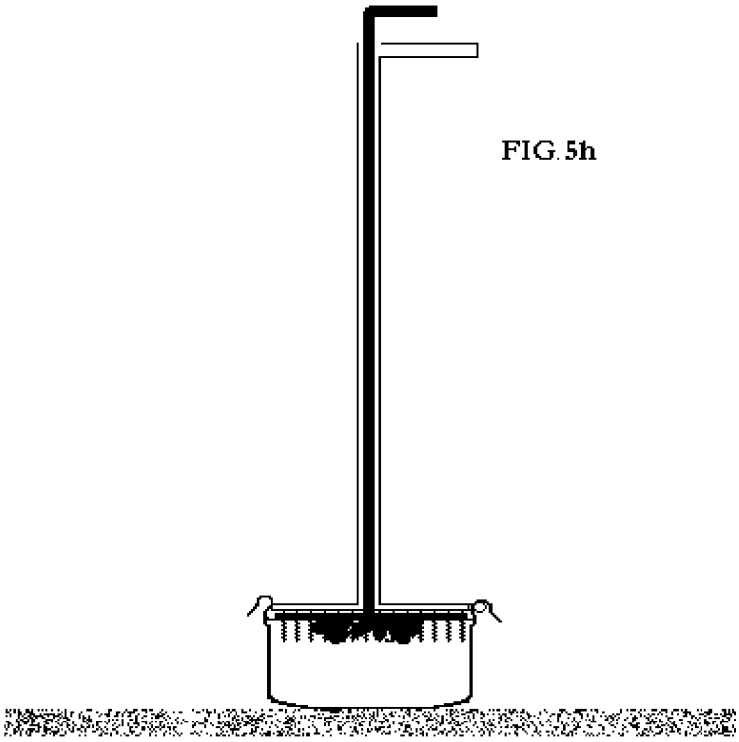
Figure 5I:
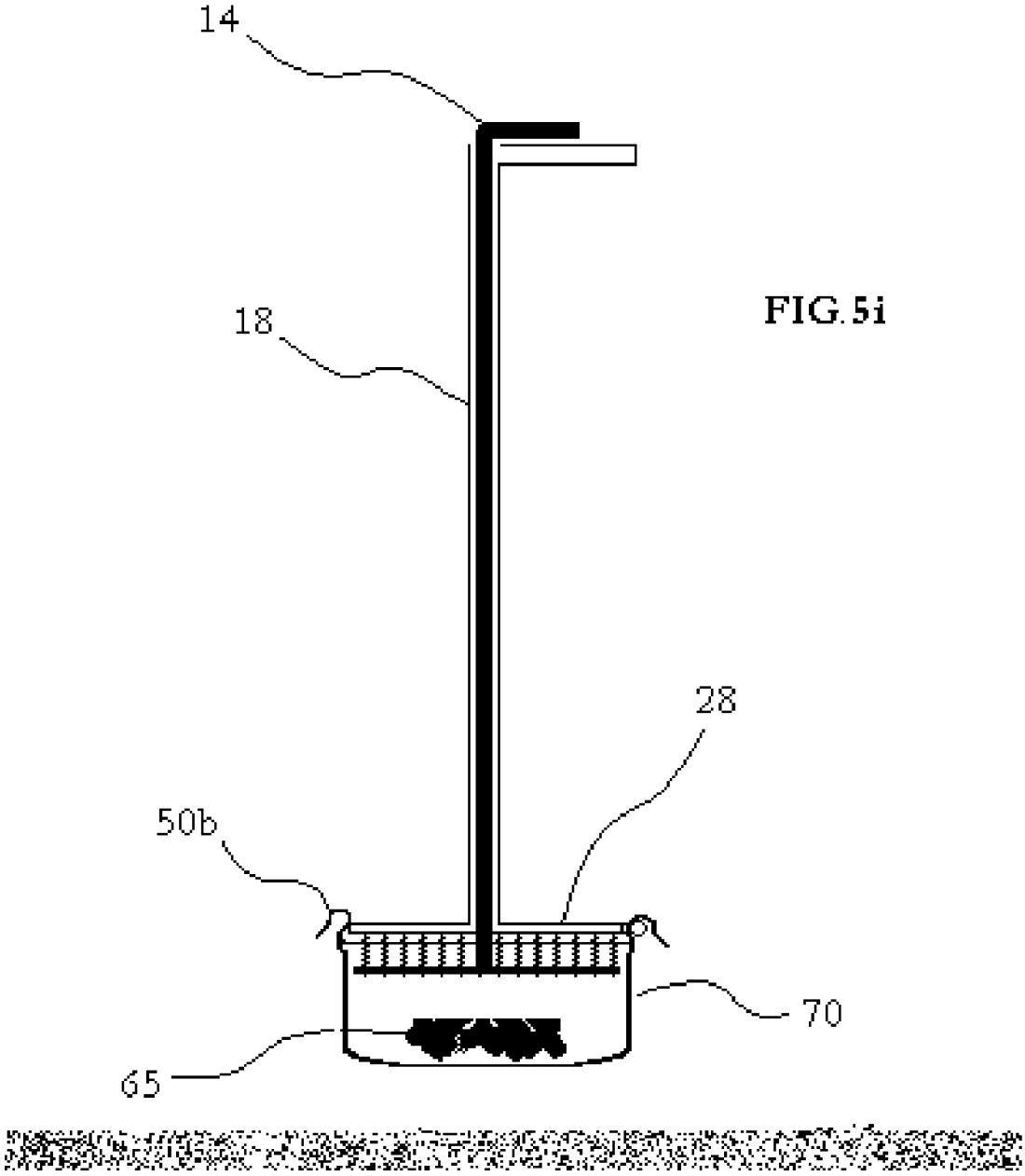

FIGS. 5*a*-5*i*, a series of plan view drawings, illustrate how the present invention is used for hands-free pick up and containment of animal droppings. When the long handled version of the present invention is used for walking a dog, for example, the device may be carried with the receptacle securely in place about the skewering barbed-tines, as illustrated in FIG. 1 and FIG. 4. Having the device molded from a sturdy, but light weight plastic, fiber glass material, metal, or the like, makes it is easy to carry the device even for longer periods of time. As soon as a need for pooper scooper use arises, the user simply strokes receptacle 70 snap lock hinge 50*b* against the ground surface so that hinge 50*b* easily and quickly snaps away from receptacle 70 providing quick access to barbed-tines 8, as illustrated in FIG. 5*a*. The barbed-tines are then positioned over excrement 65, as illustrated in FIG. 5*b* and FIG. 5*c*. A gentle pressure on handle part 18 provides for the excrement to be skewered by the tines causing plate 4 to be raised relative to plate 28 as is illustrated in FIGS. 5*c* and 5*d*. FIG. 5*d* illustrates how barbed-tines 8 firm grip on excrement 65 provides for the excrement to be lifted for disposal, as is illustrated in FIG. 5*e*. The barbs on the tines ensure a firm and secure hold of excrement 65, as illustrated in FIG. 5*f* even when the device is lifted up high enough to provide for reattachment of containment receptacle 70, if desired. Lifting the device provides for surface 75 of the receptacle to be brought into contact with the ground surface, as illustrated in FIG. 5*g*, so that another gentle pressure from the user provides for spring hinge 50*b* to snap back onto the edge of tined plate 28 as illustrated in FIG. 5*h*. If the user chooses to release the excrement from the barbed-tines before closing the receptacle, he or she simply places the excrement held on the tines over a receptacle of choice, such as a trash container or plastic bay, pushes inner handle 14 into hollow, outer handle 18 so that pusher plate 4 effectively pushes the excrement off of the barbed-tines and into the receptacle, as illustrated in FIG. 5*i*. Alternatively, a disposable bag may be routinely placed within receptacle 70 into which the excrement may be placed in order to discard the waste as wrapped waste.

Figure 6A:
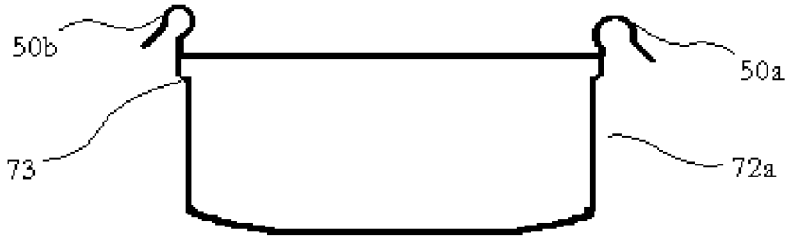
FIG. 6*a* is a side plan view of an enclosed receptacle part of the pooper scooper.

FIG. 6*a*, a side plan view, illustrates pooper scooper receptacle part 72*a* having a closed bottom. The closed bottom receptacle may be used as is or with a liner. If it is desired to line the interior of the receptacle any suitable lining material will suffice. Especially advantageous is the ability to use disposable plastic bags, such as the bags in which groceries are transported from store to home. The receptacle, however, may be used without any lining, as the material from which the receptacle is made is easily cleaned after the excrement is disposed. Lip 73 is molded into the receptacle at the time the receptacle is formed to create a shelf or ledge on the inside upper edge of the perimeter of the receptacle providing for a certain distance between tine plate 28 and the bottom of the receptacle to be maintained.

Figure 6B:
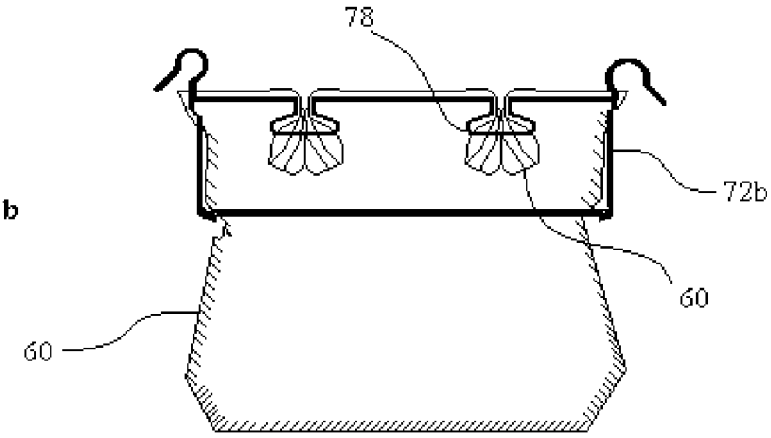
FIG. 6*b* is a side plan view of a receptacle part having an open bottom with a disposable bag detachably attached to and protruding out from the open bottom of the receptacle of the pooper scooper.

FIG. 6*b*, a side plan view, illustrates an alternative receptacle part 72*b* having an open bottom. The open bottom provides for a detachably attached disposable bag 60 to protrude out from the open bottom of the receptacle of the pooper scooper presenting more volume for disposal. Notches 78 provide for secure attachment of disposal bag 60 to receptacle 72*b*. The extra volume supplied by bag 60 may be required if the animal being walked is a large dog, for example, or if multiple animals are being walked. Even if filled with a larger amount of moist heavy waste, disposable bag 60 is held detachably, but securely by holding slots 78 in the sides of the receptacle.

Figure 6C:
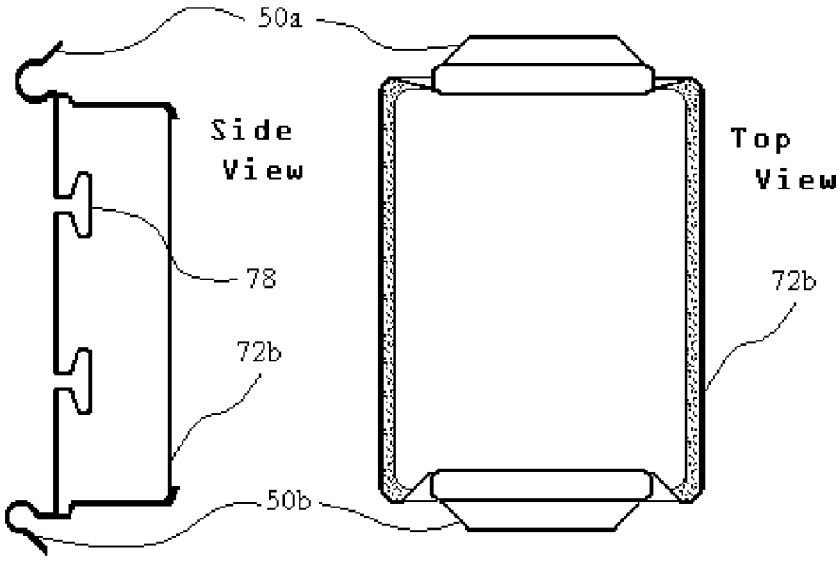
FIG. 6*c* is a side plan view of an enclosed receptacle part of the pooper scooper.

FIG. 6*c*, a side plan view relating to a top plan view of a receptacle part of the pooper scooper, is provided to better illustrate the structure of hinges 50*a* and 50*b* and holding slots 78 that serve as secure supports for holding an excrement receiving bag. As mentioned, an edge part of any type of bag-like disposal means is slipped into a slot for secure, but easily removed, holding.

Figure 7A:
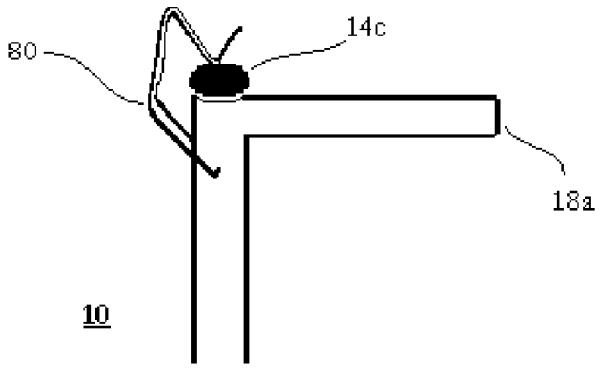
FIG. 7*a*-7*c* are sectional side views of an alternative handle embodiment.
Figure 7B:
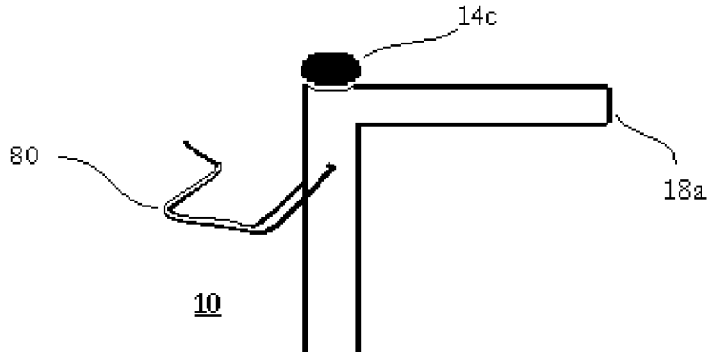
Figure 7C:
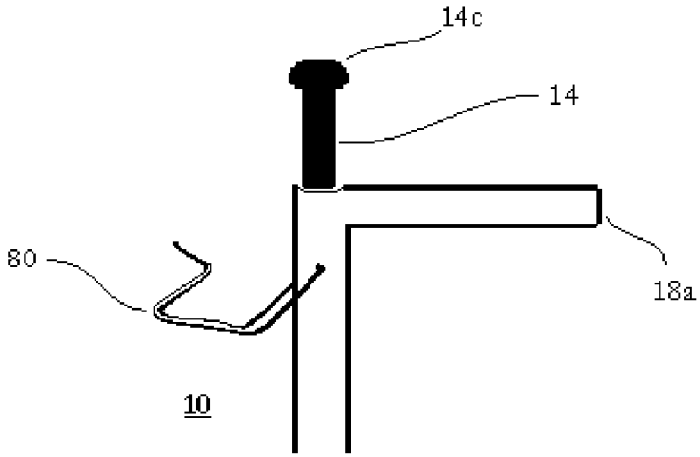

FIGS. 7*a*, 7*b*, and 7*c* illustrate an alternative version of the pooper scooper handle configuration. This embodiment introduces a knobbed-handle button action 14*c* with an optional latch that is an alternative to the bent handle of inner handle 14, as described above. Assuming that the pooper scooper, as described herein, is standing upright on a floor or other ground surface, the length of the inner handle is greater than the length of the outer handle by a distance defined as the length of the tines, as discussed above. When plate 4 is positioned to be at the tip of the tines, button action 14*c* is resting on handle 18, similar to the bent handle version as illustrated in FIG. 1. To maintain the pooper scooper in this position, wire latch 80 is latched over button 14*c*. To use the pooper scooper, wire latch 80 is unlatched from ejector button 14*c* using a slight thumb pressure. Holding handle 18*a*, barbed-tine plate 28 is positioned over a pile of doggie poop and pressed down to skewer the waste. Ejector button 14*c* will rise as the tines of barbed-tine plate 28 sink into the waste. The waste is now ready to be discarded into a plastic bag or another type of discard container as discussed above. Pressing down on ejector button 14*c* will eject the poop off of barbed-tine plate 28 into the trash container. Rinsing the working parts of the pooper scooper with water after each use keeps the barbed-tine plate 28 free of material that, if allowed to dry, may impede the operation of the pooper scooper device.

The foregoing description, for purposes of explanation, uses specific and defined nomenclature to provide a thorough understanding of the invention. However, it will be apparent to one skilled in the art that the specific details are not required in order to practice the invention. For example, the pooper scooper may be of any desired, functional shape where, for instance, the shape could change for decorative purposes. The material used to make the device may include, but is not limited to, plastic, wood, glass, or metal. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims, thus the invention is limited only by the claims.

What is claimed is:

1. A pooper-scooper device comprising:

a device structured to provide hands-free scooping up of moist and dry waste and for temporary holding of the waste for release and disposal, said device including, an elongated hollow shaft molded to include:

an open first end and an open second end having a perimeter, and a plate extending from said perimeter and having densely spaced skewers extending from said plate on the side opposite from the hollow shaft, said skewers having closely spaced barbed extensions extending radially from each of said skewers, wherein each of said barbed extensions having a pointed part projecting backward from a main point for easy entry into and difficult extraction from the waste, wherein said barbed extensions must have a degree of flexible stiffness required to skewer and support pet waste; and an axially moveable actuating rod molded to include:

a first end and a second end, said actuating rod mounted within said hollow shaft so as to be projecting from at least one end of said hollow shaft;

a mechanism on said first end of said rod for preventing said rod from being removed from said shaft, and an ejector plate attached to said second end of said rod, said plate having through holes having perimeter edges arranged for receiving said skewers therethrough, said through hole perimeter edges providing for cleaning the waste from said skewers, and said device requiring no springs, wires, levers, slots, or pegs.

2. The pooper-scooper device, as recited in claim 1, further including a hands-free detachably attachable reusable receptacle for temporary storage of waste.

3. The pooper-scooper device, as recited in claim 2, further including wherein said receptacle includes a disposable liner.

4. The pooper-scooper device, as recited in claim 3, further including wherein said disposable liner may be a recycled plastic bag.

5. The pooper-scooper device, as recited in claim 2, further including wherein said receptacle has a closed bottom.

6. The pooper-scooper device, as recited in claim 2, further including wherein said receptacle has an open bottom from which a disposable bag may extend.

7. The pooper-scooper device, as recited in claim 1, wherein said mechanism on said first end of said rod is a wire latch for preventing said rod from movement within said shaft.

8. The pooper-scooper device, as recited in claim 1, wherein said mechanism on said first end of said rod is knob-shaped.

9. The pooper-scooper device, as recited in claim 1, further including wherein a length of said rod extending from said first end of said shaft rod is bent to one side forming a handle.

10. The pooper-scooper device, as recited in claim 9, further including wherein said shaft rod bent to one side acts to maintain said rod in said shaft.

11. The pooper-scooper device, as recited in claim 1, further including wherein a length difference exists between said rod and said shaft, said length difference closely approximating the length of the barbed skewers.

12. The pooper-scooper device, as recited in claim 1, further including wherein said shaft and said rod are of a length that provides for use of the device by an adult person standing upright.

13. The pooper-scooper device, as recited in claim 1, further including wherein said shaft and said rod are of a length that provides for the device to be easily stored and carried.

14. The pooper-scooper device, as recited in claim 1, further including wherein said device is made from a molding process.

15. The pooper-scooper device, as recited in claim 1, further including wherein said device is made from a molding process utilizing a plastic material.

16. The pooper-scooper device, as recited in claim 15, further including wherein said device is made from an injection molding process.

17. The pooper-scooper device, as recited in claim 1, further including an attached strap for conveniently carrying said device.

18. A pooper-scooper device comprising:

a molded pooper-scooper device for scooping up, temporary storage, release, and disposal of pet droppings, including, a molded axially moveable inner handle part having a first end and a second end, a molded ejector plate having a pattern of apertures incised throughout, said ejector plate attached to said second end of said inner handle part, a molded hollow outer handle part for receiving inner handle part, said hollow outer handle part having an open first end and an open second end having a perimeter, a plate molded with a dense set of skewers extending from one plate side, said plate extending from the perimeter of said second end of said hollow outer handle on the side opposite said skewers, said skewers having grasping barbed extensions densely molded on said skewers so as to extend radially from said skewers, wherein each of said barbed extensions having a pointed part projecting backward from a main point for easy entry into and difficult extraction from the waste, wherein said barbed extensions must have a degree of flexible stiffness required to skewer and support pet waste;

said inner handle part receivable into said hollow outer handle part until said first end of said inner handle part protrudes from said first open end of said outer hollow handle part, said inner handle part prevented from being removed from said outer hollow handle part, and said apertures in axial alignment with said skewers providing for the movement of said skewers in and out of said apertures when said inner handle part is raised or lowered through said outer hollow handle part, said device including a hands free detachably reusable receptacle for temporary storage of waste.

* * * * *